US010091593B2

(12) United States Patent
Tan

(10) Patent No.: US 10,091,593 B2
(45) Date of Patent: Oct. 2, 2018

(54) HEARING DEVICE

(71) Applicant: SIVANTOS PTE. LTD., Singapore (SG)

(72) Inventor: Beng Hai Tan, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/412,119

(22) Filed: Jan. 23, 2017

(65) Prior Publication Data

US 2017/0215013 A1 Jul. 27, 2017

(30) Foreign Application Priority Data

Jan. 21, 2016 (DE) ..... 10 2016 200 831

(51) Int. Cl.
*H04R 25/00* (2006.01)

(52) U.S. Cl.
CPC ..... *H04R 25/554* (2013.01); *H04R 25/60* (2013.01); *H04R 2225/021* (2013.01); *H04R 2225/51* (2013.01)

(58) Field of Classification Search
CPC ..... H04R 25/554; H04R 25/60; H04R 2225/021; H04R 2225/51
See application file for complete search history.

(56) References Cited

U.S. PATENT DOCUMENTS

| | | | | |
|---|---|---|---|---|
| 4,686,339 | A * | 8/1987 | Sapone | H01H 23/145 200/330 |
| 8,542,858 | B2 | 9/2013 | Flaig et al. | |
| 8,655,000 | B1 | 2/2014 | Solum et al. | |
| 2005/0111681 | A1* | 5/2005 | Essabar | H04B 5/0012 381/315 |
| 2006/0039577 | A1* | 2/2006 | Sanguino | H04R 25/554 381/315 |
| 2011/0135127 | A1 | 6/2011 | Flaig et al. | |
| 2011/0142270 | A1 | 6/2011 | Niederdrank | |
| 2011/0211716 | A1* | 9/2011 | Cheng | H04R 25/608 381/322 |
| 2015/0048976 | A1* | 2/2015 | Petersen | H04B 5/0075 342/367 |
| 2015/0163603 | A1 | 6/2015 | Christensen et al. | |

FOREIGN PATENT DOCUMENTS

| | | | |
|---|---|---|---|
| DE | 102009006626 | A1 | 6/2011 |
| DE | 102009056916 | A1 | 6/2011 |
| EP | 2750409 | A1 | 7/2014 |
| WO | 8606919 | A1 | 11/1986 |

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

A hearing device has a housing and a switching module arranged on the housing. The switching module includes a movable switching element, operable from the outside, for changing settings of the hearing device. A coil antenna for the inductive transmission of information signals to the hearing device is inserted into a hollow space formed in the switching element.

15 Claims, 3 Drawing Sheets

HEARING DEVICE

CROSS-REFERENCE TO RELATED APPLICATION

This application claims the priority, under 35 U.S.C. § 119, of German patent application DE 10 2016 200 831.5, filed Jan. 21, 2016; the prior application is herewith incorporated by reference in its entirety.

BACKGROUND OF THE INVENTION

Field of the Invention

The purpose of a hearing device, such as a hearing aid, is to provide a person with impaired hearing with acoustic environmental signals that are appropriately processed and, in particular, amplified, to compensate for the particular hearing impairment. For this purpose, a hearing device usually comprises an input transducer, typically in the form of a microphone, a signal processing unit with an amplifier, and an output transducer. The output transducer is usually implemented as a miniature loudspeaker, and is also referred to as the earpiece or receiver. It generates the acoustic output signals for the hearing-aid wearer.

Different structural forms of hearing devices are offered in order to accommodate the numerous individual needs of hearing-aid wearers. In the so-called ITE hearing aids (In-The-Ear), a housing that contains all the functional components, including the microphone and the receiver, is worn at least partially in the ear canal. CIC hearing devices (Completely-in-Canal) are similar to the ITE hearing devices, but are worn entirely inside the ear canal. In the case of BTE hearing devices (Behind-the-Ear), a housing containing components such as a battery and the signal processing unit is worn behind the ear. A flexible sound pipe, also known as the "tube", carries the acoustic output signals of the receiver from the housing to the ear canal.

Some hearing devices are also fitted with so-called coil antennas. Coil antennas of this sort are also known in the hearing device technology art as telephone coils or as telecoils. They are usually constructed in the form of a core, in particular a ferromagnetic core, around which wire is wound. A coil antenna or telecoil is used for the inductive transmission of information signals to a hearing device, so permitting the wireless reception of electromagnetic signals in a near field that is, for example, transmitted by induction loops in lecture or conference rooms, churches or museums for the information of the hearing-aid wearer. In particular, a coil antenna also allows the direct wireless coupling of audio signals that are transmitted to an electromagnetic loudspeaker, for example in a telephone, without taking the diversion through sound signals.

A coil antenna is usually mounted on the circuit board inside the housing of a hearing device, and requires space on the circuit board and in the housing. Both the structure of the housing and also the circuit board here differ, depending on the type of hearing device. In this respect, sufficient space for the coil antenna must always be allowed for in the housing and on the circuit board in the design of different types of hearing device. It may sometimes be necessary for the arrangement of other electronic components located on the circuit board such as, for example, the signal processing elements, to be adapted in order to ensure that there is adequate space for the coil antenna. As a result, quite apart from the additional fitting of the coil antenna, both the design costs and the difficulty of manufacture are undesirably high as a result of a non-optimized arrangement of the electronic and electrical components.

SUMMARY OF THE INVENTION

It is accordingly an object of the invention to provide a hearing device which overcomes the above-mentioned and other disadvantages of the heretofore-known devices and methods of this general type and, the invention is based on the provision of a hearing device that permits the use of a coil antenna in a hearing device with lower manufacturing costs and difficulty of manufacture in comparison with the prior art.

With the foregoing and other objects in view there is provided, in accordance with the invention, a hearing device, comprising:

a housing;

a switching module disposed on said housing, said switching module including a movable switching element, operable from outside said housing, for changing settings of the hearing device, said switching element having a hollow space formed therein; and a coil antenna for inductive transmission of information signals to the hearing device inserted into said hollow space formed in said switching element.

In other words, the objects of the invention is achieved by a hearing device comprising a housing and a switching module arranged on the housing. The switching module comprises a movable switching element, operable from the outside, for changing settings of the hearing device. A coil antenna for the inductive transmission of information signals to the hearing device is inserted into a hollow space of the switching element.

In a first step, the invention starts from the consideration that not every hearing-aid wearer wants to use a hearing device with a coil antenna. Rather is it the case that the great majority of hearing devices are at present manufactured and supplied without coil antennas. For example, only about 10% of BTE hearing devices that are manufactured at present are fitted with a coil antenna. On hearing devices in which a coil antenna has been fitted, its function, if not used by the hearing-aid wearer, is sometimes switched off by the hearing care professional using appropriate software.

Nevertheless all common hearing devices continue to be designed in such a way that the use of a coil antenna is, in principle, possible. This is independent of whether a coil antenna is in fact going to be inserted in the hearing device. While it is true that in this way a range of products is made available that meet possible customer wishes, the design and manufacturing processes that are required are made more difficult and expensive, as was explained above.

The invention now solves this problem in a second step, in that it provides an arrangement of the coil antennas that differs from that of common hearing devices. For this purpose, the invention uses a switching module of a hearing device that is, in any case, necessary, comprising a movable switching element, operable from the outside, for changing settings of the hearing device. The switching element here typically comprises a hollow space in which the coil antenna is inserted.

The coil antenna thus becomes part of a switching element which is present on many types of hearing device, in particular on a BTE hearing device, and which offers sufficient space for holding a coil antenna. The invention is not, however, restricted to a BTE hearing devices and hearing aids.

Since the space for the coil antenna now no longer has to be made available on the circuit board or in the housing of the hearing device, the design of new types of hearing device is simplified. When planning and manufacturing new hearing devices, the arrangement of the components and the shape of the housing can be optimized, for example in respect of manufacturing costs, of the manufacturing method, or of the functionality, separately from the matter of housing the coil antenna. Through the arrangement of the coil antenna in the switching element, a simple manufacture of the hearing device, with and without coil antenna, is additionally possible. Without the provision of variants of the hearing device itself, simply a switching element with a coil antenna reinserted, or a switching element without such a coil antenna, is mounted on the hearing device. By exchanging the switching element in a hearing device, it is even possible for a coil antenna to be integrated subsequently into the hearing device, or for a switching element with a coil antenna to be exchanged for such an element without a coil antenna.

In an advantageous embodiment of the invention, the switching element is implemented as a hollow body. This is a usual form of construction of the switching element which, for example, is made of a plastic, and which has to exhibit an appropriate mechanical strength. The hollow body, typically on its side that faces away from the user, offers sufficient space to accept and arrange the coil antenna in a hollow space located there.

Preferably the switching module comprises a circuit board fastened to the housing, on which the switching element is counter-supported. The switching element is thus supported on the circuit board. The circuit board of the switching module is itself mounted on the housing of the hearing device, and is supported here on the housing through appropriate receptacle and/or fastening means. The circuit board of the switching module can be manufactured separately or can be formed as part of the circuit board of the hearing device on which the hearing device electronics, i.e. in particular the components of the electronic signal processing unit, are arranged.

Typically the switching element is made of plastic, wherein electric contacts for electrically contacting the coil antenna are preferably arranged on the switching element. Reception signals from the coil antenna are, in particular, read through these contacts. The electric contacts of the switching element are preferably inserted into it in a positive-locking and/or friction-locking manner. The electrical contacts are preferably pressed into the switching element.

The coil antenna is, as explained, preferably constructed in the form of a core, in particular a ferromagnetic core, around which wire is wound. The coil antenna itself expediently exhibits electrical terminals, via which the contact with the electrical contacts of the switching element is made when in the installed state. For this purpose the electrical terminals of the coil antenna are, for example, soldered or mechanically contacted by the electrical contacts of the switching element.

In accordance with an added feature of the invention, the switching element is mounted movably on a stand. The stand itself is expediently fastened to the circuit board. The stand comprises a base body which is preferably manufactured of a non-conductive plastic. In order to contact the coil antenna, which is arranged in the mounted switching element, the stand preferably itself further comprises the physical contacts. The stand is in particular soldered by its electrical contacts to the circuit board, and thereby mounted. In appropriate cases a mechanical support is provided for fastening to the circuit board. The electrical contact between the stand and the fitted coil antenna is expediently made by means of the electrical contacts of the switching element.

In an advantageous development, the electrical contacts of the stand also serve a further function in addition to contacting the coil antenna. For this purpose, in a preferred embodiment, the electrical contacts of the stand at the same time form a bearing for the switching element. For this purpose the electrical contacts of the stand expediently comprise a bearing pin. Preferably each electrical contact of the stand comprises its own bearing pin. The design of the electrical contacts of the stand as bearings further has the advantage of supporting the movable switching element in a robust manner, while at the same time providing a secure possibility for the electrical contact, independently of the position of the switching element. The electrical contacts of the switching element are for this purpose expediently contacted electrically in the bearing with the electrical contacts of the stand. Through a double-sided bearing, the coil antenna built into the switching element is directly connected into an electrical circuit.

In a further advantageous embodiment, the switching element is formed as a rocker switch extending along a longitudinal direction. A hearing-aid wearer can make changes to the settings of the hearing device by actuating the rocker switch. Depending on the hearing device, this includes, for example, changing the listening program and/or adjusting the volume. Corresponding pushbuttons are, for example, actuated by the ends of the rocker switch in order to change the settings. The coil antenna is preferably inserted parallel to the longitudinal direction of the rocker switch. Sufficient room is available in this direction for the typically longitudinally extending coil antenna.

The hearing device further comprises inside the housing an input transducer, a signal processing unit connected to the input transducer, as well as an output transducer connected to the signal processing unit, wherein the switching module and the coil antenna are connected to the signal processing unit by means of signal technology.

The input transducer is preferably implemented as a microphone. It absorbs ambient sounds. The signal processing unit processes the microphone signals and amplifies them. The output signal from the signal processing unit is then transmitted to the output transducer, expediently a loudspeaker or earpiece, which outputs an acoustic signal. The sound is transmitted to the eardrum of the hearing-aid wearer. The supply of energy for the hearing device and for the signal processing unit is expediently made by means of a battery, also arranged within the housing.

The signal processing unit detects an actuation of the switching element preferably by means of appropriate switch contacts on the circuit board. These switch contacts are expediently designed as pushbuttons.

Other features which are considered as characteristic for the invention are set forth in the appended claims.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
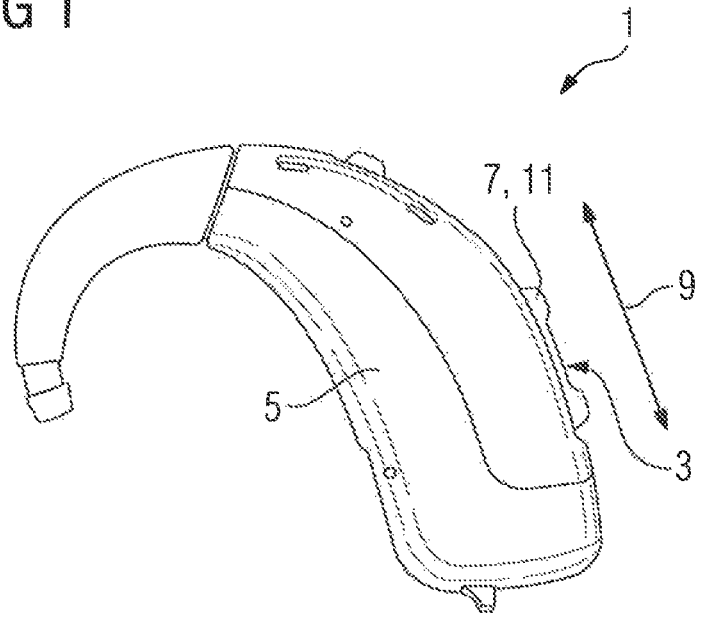
FIG. 1 is a side view of a behind-the-ear hearing device with a switching module according to the invention.

Referring now to the figures of the drawing in detail and first, particularly, to FIG. 1 thereof, there is shown a hearing device 1 with a switching module 3. The device is a behind-the-ear (BTE) hearing aid 1 with a plastic housing 5. An input transducer, a signal processing unit connected to the input transducer, and an output transducer connected to the signal processing unit are arranged inside the housing. Due to the closed illustration of the housing 5, these components are not at present visible.

The switching module 3 is arranged at the housing 5, and comprises a movable switching element 7 that is movable from the outside. The switching element 7 is in the present case formed as a rocker switch 11 extending along the longitudinal direction 9, and also made of plastic. The longitudinal direction 9 of the rocker switch 11 coincides with the longitudinal direction of the housing 5.

The switching element 7 is, for example, used to change settings of the hearing device 1. In the present case the switching element 7 comprises, on its side that faces the housing 5, a hollow space 13 which is not visible when in the installed state. A coil antenna is inserted into this hollow space 13, as can be seen in FIG. 2.

Figure 2:
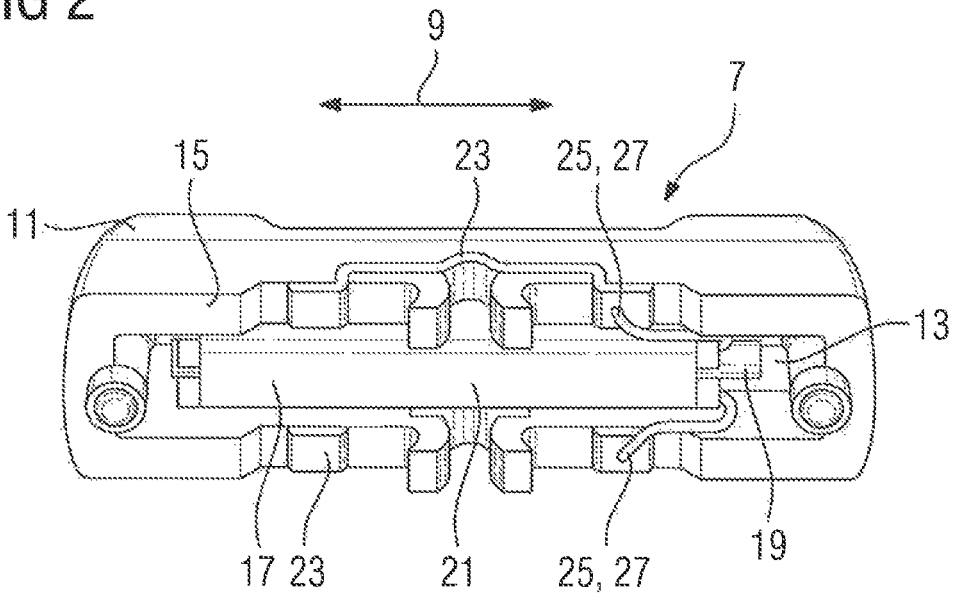
FIG. 2 is a perspective view of a switching element with a coil antenna.

The switching element 7 is formed as a hollow body 15, as seen in FIG. 2. A coil antenna 17 is inserted in the hollow space 13 parallel to the longitudinal direction 9. The coil antenna 17 serves to inductively transfer information signals to the hearing device 1. It is designed in the form of a core 19, in particular a ferromagnetic core, around which a copper wire 21 is wound.

Electrical contacts 23 in the form of curved metal clips are arranged on both sides of the rocker switch 11 for electrically contacting the coil antenna 17 installed in the switching element 7. In the present case, the electrical contacts 23 are inserted, or pressed with mechanical force, into corresponding recesses of the switching element 7. The coil antenna 17 further comprises two electrical terminals 25, through which the contact with the electrical contacts 23 of the switching element 7 is made, for example by means of soldering. The electrical terminals 25 of the coil antenna are formed by the ends 27 of the copper wire 21.

Figure 3:
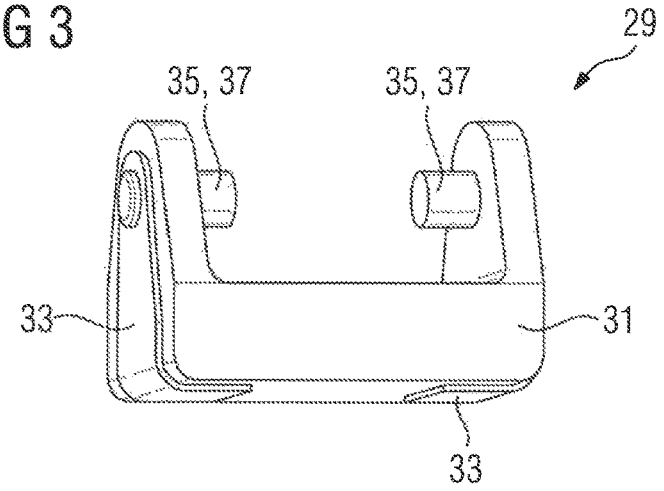
FIG. 3 is a perspective view of a stand for a switching element.

FIG. 3 shows a stand 29, or support stand, on which the switching element 17 of the switching module 3 is movably mounted. The stand 29 is made with a base body 31 of a non-conductive plastic, and comprises at its narrow faces two metal electrical contacts 33 for contacting the coil antenna 17 that is installed in the rocker switch 11. The electrical contacts 33 of the stand 29 here at the same time constitute a bearing 35 for the switching element 7. Both electrical contacts 33 of the stand 29 here each comprise a bearing pin 37 onto which, when in the final assembled state, the electrical contact 23 of the coil antenna 17, which are formed as metal clips, are placed.

Figure 4:
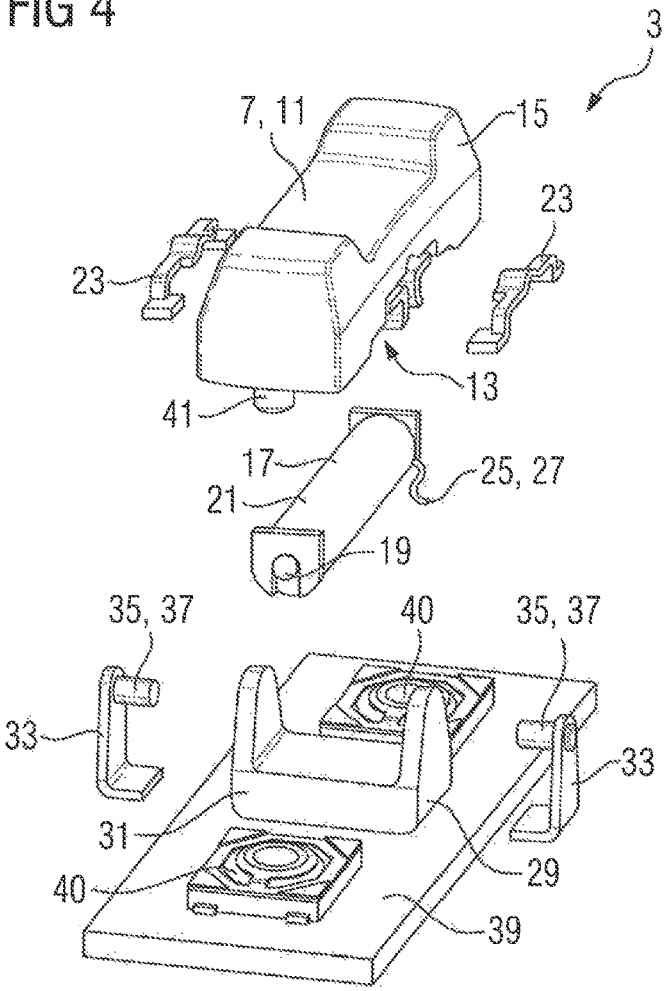
FIG. 4 is an exploded view of the switching module according to FIG. 1.

The assembly of the switching module 3 can be seen in FIG. 4. An exploded view of the switching module 3 is shown here. The electrical contacts 23 of the switching element 7 are inserted or pressed into the switching element 7 from the side, transversely to the longitudinal direction 9. The coil antenna 17 is then inserted into the hollow space 13 of the switching element 7, and the terminals 25 of the coil antenna 17 are contacted with the electrical contacts 23 of the switching element 7, for example by soldering. The coil antenna 17 is in particular held by friction-locking in the hollow space 13. It is, however, additionally secured, for example by gluing.

The switching module 3 further comprises a circuit board 39 fastened to the housing 5 of the hearing device 1 in accordance with FIG. 1, on which the switching element 7 is counter-supported by way of the stand 29. The switching element 7 is thus supported on the circuit board 39. The stand 29 is here soldered by its electrical contacts 33 onto the circuit board 39. The electrical contacts 33 are each appropriately extended for this purpose, and bent over at their ends onto the lower side of the stand 29. When the switching element 7 is fitted, it is placed, with its appropriately formed electrical contacts 23, onto the bearing pins 37 of the electrical contact 33 of the stand 29, whereby a movable electrical contact 23 of the coil antenna 17 with the electrical contact 33 of the standard 29 is achieved.

Pushbuttons 40 are further arranged on the circuit board 39, and are actuated by the ends 41 of the rocker switch 11. A signal processing unit, not illustrated, of the hearing device 1 detects a relevant actuation of the push buttons 40, and evaluates this in respect of a change of settings.

Figure 5:
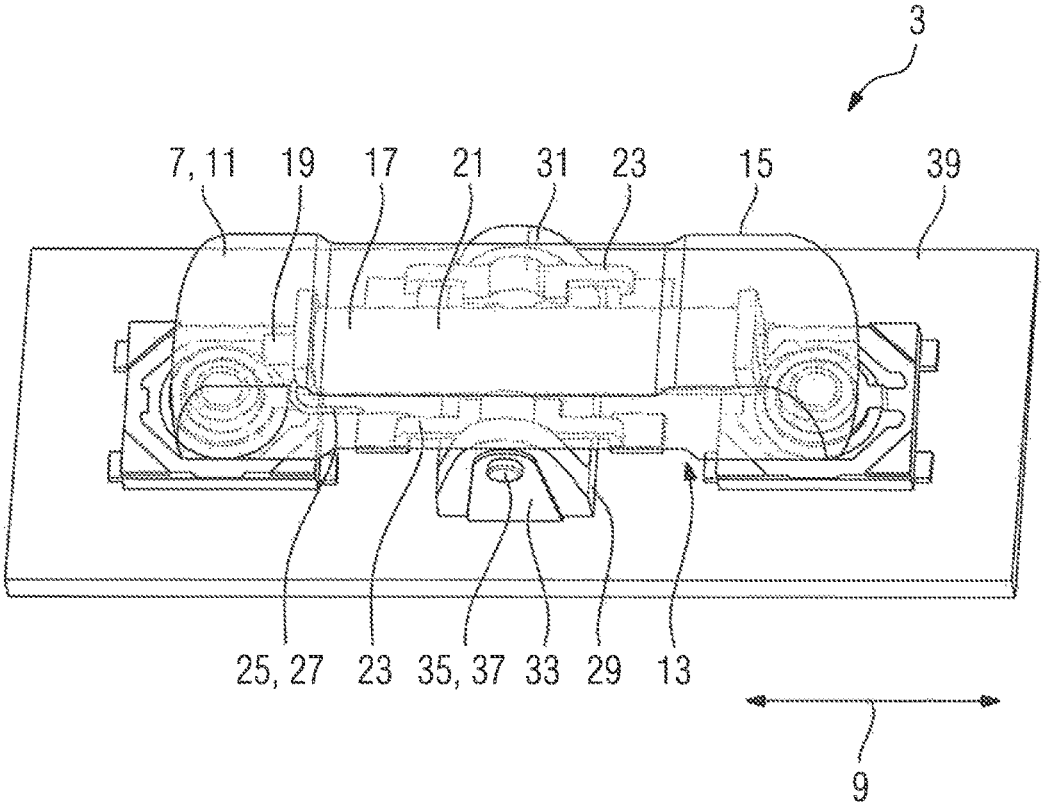
FIG. 5 is a perspective, partly transparent illustration of the assembled switching module according to FIGS. 1 and 4.

The assembled switching module 3 is illustrated in FIG. 5. The switching element 7 is here drawn transparently, so that the components that are located underneath the switching element 7 can be seen. The housing 5, in which the circuit board 39 is arranged in the assembled hearing device 1, is not shown here.

The coil antenna 17 is supported by the electrical contacts 23, formed as metal clips, of the rocker switch 11 movably on the bearing pins 37 of the electrical contact 33 of the stand 29, and is electrically contacted at the same time. The coil antenna 17 is connected into an appropriate electrical circuit for evaluating the inductive reception of information signals through the electrical contacts 33 of the stand 29 which are soldered to the circuit board 39.

Altogether, a hearing device 1, in which the coil antenna 17 is inserted into the switching element 7 instead of on the circuit board 39, permits a simplification of the design and fabrication of the hearing device 1, and thus a savings in cost. In addition, customers' wishes can also be met flexibly. In the event of a subsequent wish to use the advantages of a coil antenna 17, the option exists of retrofitting by exchanging the switching element 3. Room for the installation of a coil antenna 17 does not have to be maintained in the hearing device 1. The switching element 7 is designed in such a way that, without structural change, it can be mounted, with or without a coil antenna 17 inserted, on the switching module 3 or the hearing device 1. A standardized switching element 7 is accordingly manufactured. A coil antenna 17 is inserted into a certain proportion of these switching elements 7. Through the assignment of the switching elements 7 to the hearing device 1, hearing devices 1 are manufactured with and without a function of the coil antenna 17. A subsequent refit is also easily enabled by exchanging the switching element 17.

The following is a summary list of reference numerals and the corresponding structure used in the above description of the invention:

1 Hearing device
3 Switching module
5 Housing
7 Switching element
9 Longitudinal direction
11 Rocker switch
13 Hollow space
15 Hollow body
17 Coil antenna
19 Core
21 Wire
23 Electrical contact of switching element
25 Electrical terminal of coil antenna
27 End of the wire
29 Support stand
31 Base body
33 Electrical contact of the stand
35 Bearing
37 Bearing pin
39 Circuit board
40 Pushbutton
41 End

The invention claimed is:

1. A hearing device, comprising:

a housing;

a switching module disposed on said housing, said switching module including a movable switching element, operable from outside said housing, for changing settings of the hearing device, said switching element having a hollow space formed therein; and a coil antenna for inductive transmission of information signals to the hearing device inserted into said hollow space formed in said switching element.

2. The hearing device according to claim 1, wherein said switching element is a hollow body.

3. The hearing device according to claim 1, wherein said switching module comprises a circuit board fastened to said housing and supporting said switching element thereon.

4. The hearing device according to claim 1, wherein said switching element is made of plastic, and wherein electrical contacts for electrically contacting said coil antenna are disposed on said switching element.

5. The hearing device according to claim 4, wherein said electrical contacts are inserted into said switching element with a positive-locking engagement and/or a friction-locking engagement.

6. The hearing device according to claim 1, which comprises a stand disposed to movably support said switching element.

7. The hearing device according to claim 6, wherein said stand comprises electrical contacts for contacting said coil antenna.

8. The hearing device according to claim 7, wherein said electrical contacts of said stand form a support for said switching element.

9. The hearing device according to claim 8, wherein said electrical contacts of said stand include a bearing pin.

10. The hearing device according to claim 8, wherein said switching element is made of plastic, wherein electrical contacts for electrically contacting said coil antenna are disposed on said switching element, and wherein said electrical contacts of said switching element are contacted electrically in said support with said electrical contacts of said stand.

11. The hearing device according to claim 1, which comprises a stand disposed to movably support said switching element, and wherein said switching module comprises a circuit board fastened to said housing and supporting said switching element thereon, and wherein said stand is soldered to said circuit board.

12. The hearing device according to claim 11, wherein said stand is soldered to said circuit board by way of said electrical contacts.

13. The hearing device according to claim 1, wherein said switching element is a rocker switch extending along a longitudinal direction defined by said housing.

14. The hearing device according to claim 13, wherein said coil antenna is inserted parallel to the longitudinal direction of said rocker switch.

15. The hearing device according to claim 1, which comprises an input transducer, a signal processing unit connected to said input transducer, and an output transducer connected to said signal processing unit disposed inside said housing, and wherein said switching module and said coil antenna are connected to said signal processing unit for signal transfer.

* * * * *